US007770233B2

(12) United States Patent
Haskell

(10) Patent No.: US 7,770,233 B2
(45) Date of Patent: Aug. 10, 2010

(54) ENERGY ABSORBING GARMENT

(76) Inventor: Thomas Rex Haskell, 60 Waterfall Road, Raumati South (NZ)

( * ) Notice: Subject to any disclaimer, the term of this patent is extended or adjusted under 35 U.S.C. 154(b) by 1038 days.

(21) Appl. No.: 10/522,459

(22) PCT Filed: Jul. 11, 2003

(86) PCT No.: PCT/NZ03/00150

§ 371 (c)(1),
(2), (4) Date: Jan. 24, 2005

(87) PCT Pub. No.: WO2004/006702

PCT Pub. Date: Jan. 22, 2004

(65) Prior Publication Data

US 2006/0005305 A1 Jan. 12, 2006

(30) Foreign Application Priority Data

Jul. 11, 2002 (NZ) ..... 520124

(51) Int. Cl.
*A41D 13/00* (2006.01)

(52) U.S. Cl. ..... 2/69

(58) Field of Classification Search ..... 2/97, 2/108, 69, 93, 94, 81, 456, 458
See application file for complete search history.

(56) References Cited

U.S. PATENT DOCUMENTS

| | | | | |
|---|---|---|---|---|
| 4,004,493 | A | 1/1977 | Costanza | |
| 4,241,457 | A | 12/1980 | Klein et al. | |
| 5,007,108 | A | 4/1991 | Laberge et al. | |
| 5,140,995 | A | 8/1992 | Uhl | |
| 5,515,541 | A | 5/1996 | Sacks et al. | |
| 5,794,261 | A | 8/1998 | Hefling | |
| 5,915,528 | A | 6/1999 | Shmuelov | |
| 6,907,619 | B2 * | 6/2005 | Gathings, Jr. | 2/97 |
| 2001/0029621 | A1 | 10/2001 | Howland et al. | |

FOREIGN PATENT DOCUMENTS

| | | |
|---|---|---|
| DE | 42 14 543 A1 | 11/1993 |
| EP | 0 134 727 | 3/1985 |
| EP | 0 436 788 A1 | 7/1991 |
| EP | 0 657 110 A1 | 6/1995 |

(Continued)

OTHER PUBLICATIONS

Supplementary European Search Report Application No. EP 03 74 1694, Mar. 23, 2006, 2 pages.

*Primary Examiner*—Tejash Patel
(74) *Attorney, Agent, or Firm*—Thomas R. Vigil

(57) ABSTRACT

The invention comprises an energy absorbing and/or spreading garment for protection against an impact or a fall, the garment including an inner layer (2), an outer layer (1), a plurality of arcuate panels (3,4,5) housed between the inner layer (2) and the outer layer (1) of the garment, and wherein each panel (3,4,5) is arranged to overlap at least one adjacent panel in sliding relationship with the at least one adjacent panel. Impacts from falling off a horse or being kicked by a horse will cause the panels (3,4,5) to deform, spreading the energy of the impact. The panels (3,4,5) to deform, spreading the energy of the impact. The panels (3,4,5) also slide against each other further spreading the force of the impact.

23 Claims, 5 Drawing Sheets

FOREIGN PATENT DOCUMENTS

| | | |
|---|---|---|
| FR | 2 706 318 | 12/1994 |
| GB | 2 328 859 | 3/1999 |
| GB | 2 368 775 | 5/2002 |
| GB | 2 378 890 | 2/2003 |
| JP | 08036286 | 9/1997 |
| JP | 2000-283696 | 10/2000 |
| WO | WO 00/31494 | 6/2000 |
| WO | WO 01/87432 | 11/2001 |

* cited by examiner

ENERGY ABSORBING GARMENT

FIELD OF INVENTION

The invention relates to an energy absorbing garment and in particular to an energy absorbing garment adapted to absorb energy from an impact or fall.

BACKGROUND

Conventional equestrian protection clothing uses 15 to 20 mm thick foam plastics blocks arranged in a manner similar to a buoyancy aid. These blocks have the ability to absorb impact energy, but limited ability to spread it out over the body. However foam plastics is an insulating material and wearers of foam plastics equestrian protection consider that garments using the blocks are hot and uncomfortable as well as bulky and inflexible. Whilst foam plastics blocks absorb impact energy from a fall or other low grade impacts the foam plastics blocks are less effective in directed impacts such as a kick from a horse.

Currently available alternative systems also contain problems. For example U.S. Pat. No. 5,794,261 describes a joint protective guard for use in sports such as softball and baseball. The guard includes a number of curved pieces each having an upper surface level and a lower surface level. The lower level of each piece is attached to the upper level of the next piece at each end so that two pieces are pivotable relative to each other. This allows the guard to be flexed to fit around a wearer's shoulder, elbow or knee joint without leaving any of the joint exposed. However this system does not spread the energy of an impact and is limited in usefulness to moveable joints.

A second existing system is described by U.S. Pat. No. 4,241,457 and comprises a bullet proof vest. The vest of the invention includes two layers of segmented panels. Each layer of panels comprises a plurality of panels that are regularly shaped and in a compressed state sit flat, side by side. The lower layer of panels is offset from the upper layer with a major portion of corresponding segmented panels in each layer overlapping. Panels are adhered in the major portion of overlap. The lower layer of panels is also adhered to a backing material. In this way the layers of panels can be flexed in a convex direction from the backing material. When a bullet or other object impacts on a panel in the upper layer of panels the panel moves to its compressed state and spreads the impact energy into the adjacent panels in the lower layer. The panels in the lower layer also move to the compressed state and further spread the impact energy to any adjacent panels in the upper layer and so on. The disadvantage of this system is that the panels all move to the rigid compressed state when impacted which reduces the flexibility of the vest.

There is a need for a protection garment that overcomes the problems of inflexibility, heat and bulkiness in the current foam plastics protection garments and provide protection from a range of impacts.

SUMMARY OF INVENTION

It is the object of the invention to overcome or alleviate the disadvantages of existing garments described above or to at least provide the public with a useful choice.

In broad terms the invention comprises an energy absorbing and/or spreading garment including an inner layer, an outer layer, a plurality of arcuate panels housed between the inner layer and the outer layer of the garment, and wherein each panel is arranged to overlap at least one adjacent panel in a sliding relationship with the at least one adjacent panel.

Preferably the garment includes a plurality of channels or pockets between the inner layer and the outer layer of the garment. Preferably each channel is arranged to house one column of arcuate panels.

In one embodiment the cross-section of each panel includes two lower side portions and a higher middle portion. In one embodiment using these panels, the panels are arranged so that one side portion of a first panel is adjacent to the middle portion of a second panel. One side portion of the second panel is adjacent the middle portion of a third panel etc. In this embodiment each panel is arranged in a sliding relationship with the adjacent panels.

In another embodiment the panels are arranged in a symmetrical pattern with the axis of symmetry running between the centre of the front of the garment and the centre of the back of the garment. In this embodiment a centre panel with higher middle portion and lower side portions is situated between a first left side panel and a first right side panel. Both the first left side panel and the first right side panel have one side adjacent the middle portion of the centre panel. A second left side panel has one side adjacent the middle of the first left side panel. A second right side panel has one side adjacent the middle of the first right side panels etc. In this embodiment each panel is arranged in a sliding relationship with the adjacent panels.

In another embodiment the cross-section of each panel extends between a first side and a second side and includes an upper and lower middle portion. In this embodiment the panels are arranged so that the lower middle portion of a first panel is adjacent a first side portion of a second panel. The second side portion of the first panel is adjacent to the upper middle portion of the second panel. The lower middle portion of the second panel is adjacent to the first side portion of a third panel and the second side portion of the second panel is adjacent to the upper middle portion of the third panel. Each adjacent portion of each panel is arranged in a sliding relationship with the other adjacent portions.

The panels may be arranged in a sliding relationship using a rivet and slot system. In this system at each point where panels are adjacent at least one panel is provided with a slot and the panels are riveted with the rivet arranged to slide along the slot and allowing a sliding relationship between adjacent panels.

Preferably the panels are arranged to form rows across the garment with each panel in the row housed in a channel or connected to the adjacent panel(s) by a suitable sliding connection means. The garment may be provided with more than one row of panels where panels form columns in each channel. The garment may also be provided with overlap between the panels in each channel, i.e. there may be overlap between the panels in each channel.

In one embodiment the panels are formed from resilient deformable material. Ideally the panels are formed from material that deforms upon impact but regains its shape after impact. Preferably in this embodiment the panels are formed from plastics. Ideally the panels are formed from PVC and/or laminates.

In another embodiment the panels may be formed from a more rigid material such as metal. In this embodiment after a panel has received an impact of greater than a predetermined force it may permanently deform and may need to be replaced.

In one embodiment the garment may further be provided with perforations to allow air to flow through the garment to a wearer. In other embodiments no perforations are provided.

Preferably the inner and outer layers of the garment are formed of fabric. In one embodiment the fabric of the inner and outer layers includes one-way stretchability. Ideally this stretchability is arranged to run across the garment.

BRIEF DESCRIPTION OF DRAWINGS

Preferred form garments of the invention will be further described with reference to the accompanying drawings by way of example only and without intending to be limiting, wherein.

DETAILED DESCRIPTION

Figure 1:
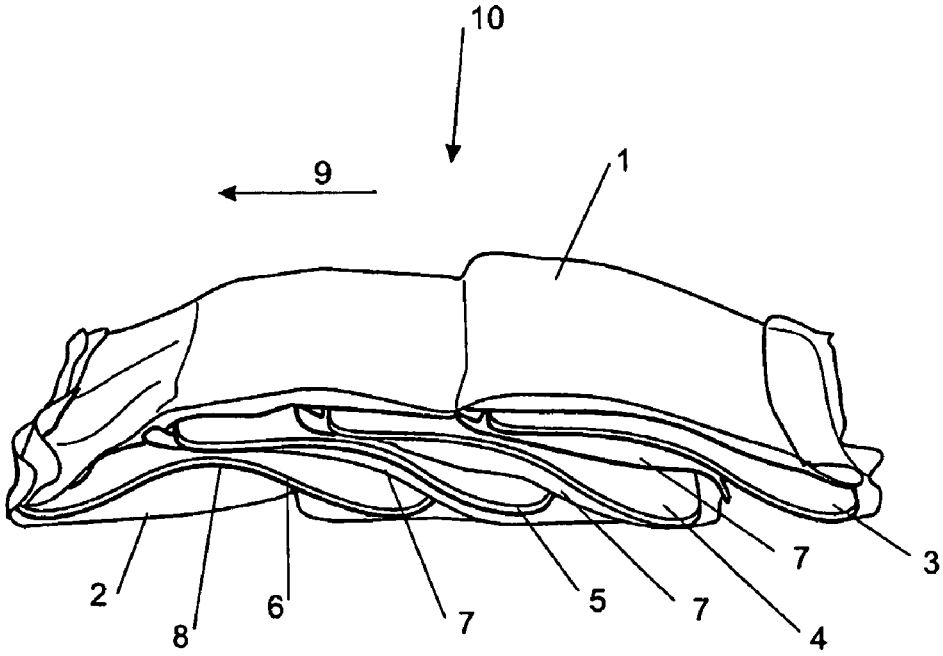
FIG. 1 is a cut away portion of a garment showing a series of panels between the inner and outer layers of the garment.

FIG. 1 shows a cut out portion of a garment of the invention showing an outer layer of the garment 1, an inner layer 2, a plurality of panels 3-6, and channels between the outer and inner layers of the garment formed by strips 7.

In the embodiment shown in FIG. 1 the panels have an arcuate cross-section 8 with two lower sides and a higher middle section. The cross-section extends through the panel from the front end to the back end providing a panel with regular cross-section and shape.

In another embodiment the panels are arranged, in a sliding arrangement, in a symmetrical arrangement with the axis of symmetry running between the centre of the front of the garment and the centre of the back of the garment. For example, in a jacket arrangement the axis of symmetry runs between the breastbone and the spine. In this arrangement panel 6 has a different dimensions to the other panels. Here panel 6 is symmetrical and has greater height between the middle portion and the side portions than panels 5-3. As well as this panels 5-3 (the right side panels) have a flatter left side than right side. The left side panels are ideally mirror images of the right side panels. Panel 6 is designed to sit in front of the breastbone or spine. If panel 6 is in front of the breastbone panels 5-3 run towards the right of a wearer of the garment. Further panels are provided that are arranged symmetrically to panels 5-3 on the other side of panel 6. The same configuration may be included at the back of the garment with a column of panels 6 sitting over the spine. This provides added protection to vulnerable parts of the body like the breastbone and spine. In the case of the spine for further protection a larger panel with smaller radius of curvature may be provided. This larger panel sits over panel 6 and at least a portion of the panels on either side of panel 6.

In this embodiment the centre panel is situated between a first left side panel and a first right side panel. Both the first left side panel and the first right side panel have one side adjacent the middle portion of the centre panel. A second left side panel has one side adjacent the middle of the first left side panel. A second right side panel has one side adjacent the middle of the first right side panels etc. In this embodiment each panel is arranged in a sliding relationship with the adjacent panels.

In another embodiment the panels are arranged in a sliding arrangement so that the first side of first panel 3 overlaps adjacent panel 4. The first side of panel 4 then overlaps adjacent panel 5, etc. This arrangement may be continued to form a complete loop around the garment. If the panels are not arranged to form a complete loop then the second side of one panel on one end (for example panel 3 in FIG. 1) is not adjacent any other panel and the first side of the panel on the other end (for example panel 6 in FIG. 1) is not adjacent any other panel.

In FIG. 1 the sliding arrangement of the panels 3-6 is assisted by the formation of channels between the outer layer 1 of the garment and the inner layer 2 of the garment. Partition strips 7 that extend between the outer and inner layers of the garment form these channels. Each channel is arranged to house one panel as shown in FIG. 1 or a column of panels. Although the strips 2 are shown at an angle between the outer and inner layers when formed the strips may run perpendicular to the outer and inner layers.

In this embodiment once the inner and outer layers and the channels have been formed the panels are slotted into the channels. The outer layer is then rotated in direction 9 with respect to the inner layer to produce the arrangement of the panels and channels as shown in FIG. 1.

Figure 2:
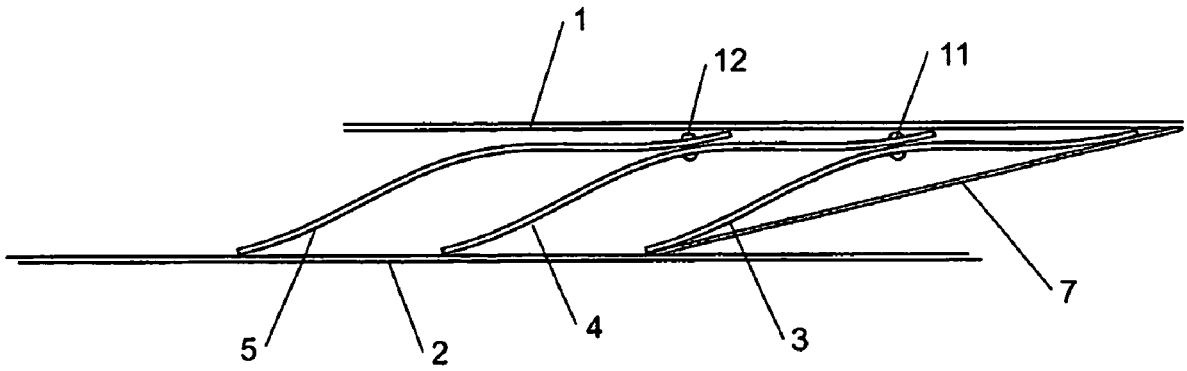
FIG. 2 shows a series of panels connected together between the inner and outer layers of the garment.
Figure 6:
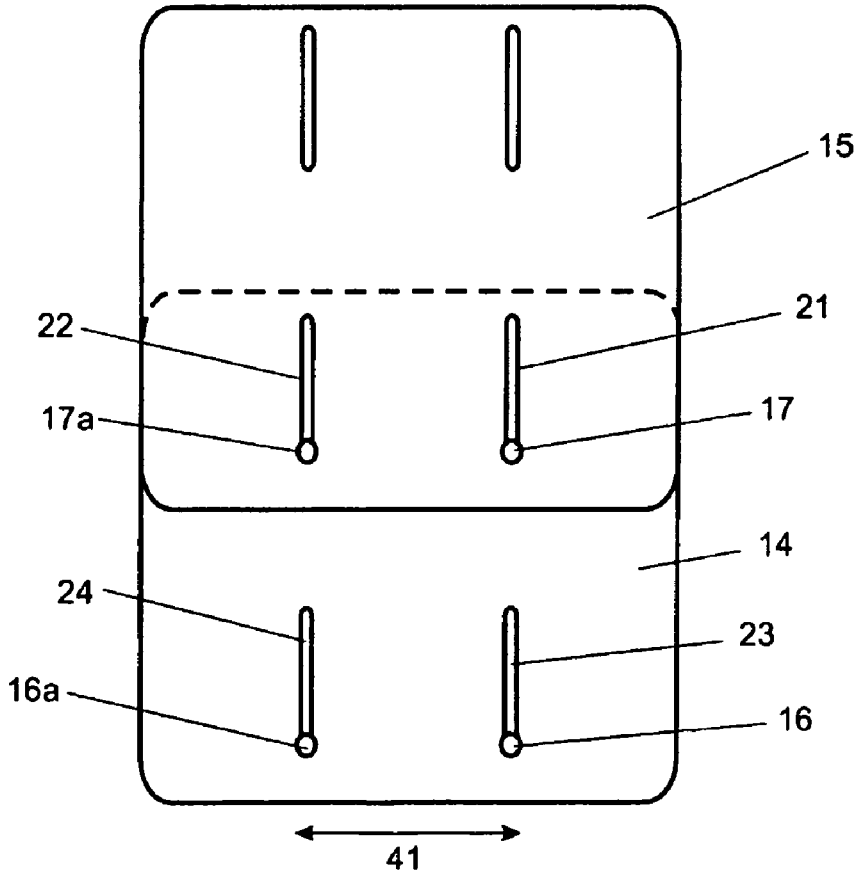
FIG. 6 is a top view of the panels of FIG. 5 showing the connections between the panels.

FIG. 2 shows an alternative arrangement of the panels that allows the panels to move in a sliding relationship. FIG. 2 is an end-on view of a cut-away part of the garment with outer layer 1 and inner layer 2 as before. Strip 7 forms part of a channel between the inner and outer layers of the garment. Here a single channel houses more than one panel in both rows and columns. Panels 3, 4 and 5 are connected together in a row in a sliding manner by rivets 11, 12. Each rivet connects the middle section of one panel to one side of the adjacent panel. For example rivet 11 connects the middle portion of panel 3 to one side of panel 4. In one embodiment the sides of the panels adjacent the centre of other panels have a hole formed in the side to accommodate the rivet and the centre of each panel includes a slot arranged to accommodate the rivet and to allow the rivet to move up and down the slot. Each panel may have more than one hole and slot along its length as shown in FIG. 6.

The garment is designed to withstand impact forces such as those that occur when a horse rider falls off a horse or onto an obstacle on the ground. Impacts from falling off a horse or being kicked by a horse will impact on the garment from the outside of the garment in the general direction shown by arrow 10 (of FIG. 1). Impacts of sufficient force cause the panels of the garment to deform. This deformation of the panels spreads the energy of the impact. The panels also slide against each other further spreading the force of the impact. The garment reduces and spreads the impact force felt by the wearer thereby preventing an injury or reducing the severity of an injury.

The panels used in garments suitable for equestrian protection are formed from resilient deformable material. The material of the panels must be sufficiently deformable to deform under large impact forces. The panels must also be resilient and regain their original shape after impact. Some plastics are suitable materials for panels. In particular 3 mm thick PVC is a suitable panel material. Any other material with suitable resiliency and deformation characteristics may be used for the panels. These panels may also be used in other protective clothing, for example as part of hard hats etc. In another embodiment the panels include strands of material such as fibreglass through the middle portion of the panels. If the panels deform past a predetermined point the fibreglass strands may break further absorbing energy. In this embodiment panels with broken fibreglass strands will require replacement.

In some garments the garment must spread the force of an impact without allowing the item that made the impact to penetrate the garment. One example of this type of garment is the bullet proof vest. These vests are designed to prevent a bullet penetrating the wearer of the vest. In embodiments such as bullet proof vests panels are formed from a more rigid material, for example metal or ceramics, that are not resiliently flexible (or elastic) but have plasticity to prevent penetration of the projectile. In a bullet proof vest a panel hit by a bullet may permanently deform and will need replacement. In this embodiment the panels spread and absorb a portion of the impact energy of the projectile.

FIGS. 3A to 3D show an impact test performed on a portion of a garment of the invention. The impact was provided by an 80 mm diameter, 5 kg drop impactor 45 on a sliding track. This impactor has a weight specification similar to that specified by The Beta Standard for Horse Riders' Body and Shoulder Protectors by the British Equestrian Trade Association Limited (BETA). The impactor was attached to an accelerator and the portion of the garment under test was clamped to a load cell. This arrangement allowed measurement of both the acceleration of the impactor and the forces on the portion of the garment under test.

Figure 3A:
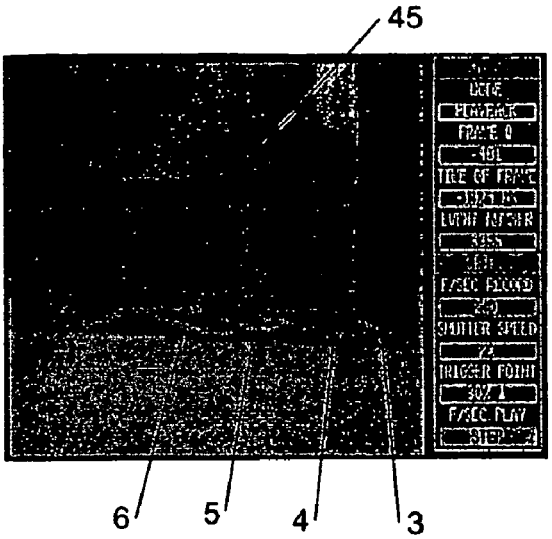
FIG. 3A shows an impact test on a portion of a garment of the invention from a first drop height.
Figure 3B:
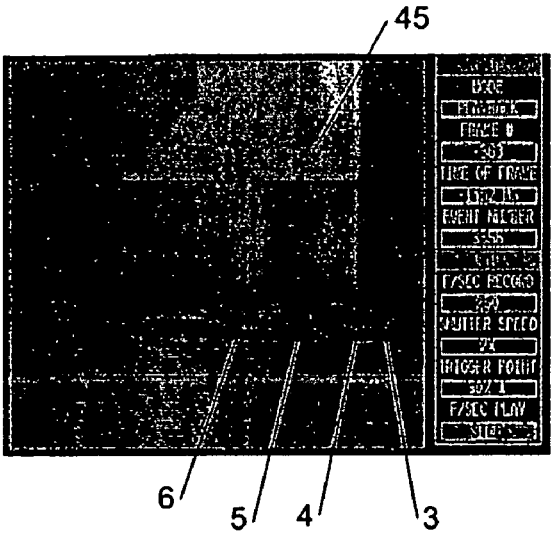
FIG. 3B shows an impact test on a portion of a garment of the invention from a second drop height.
Figure 3C:
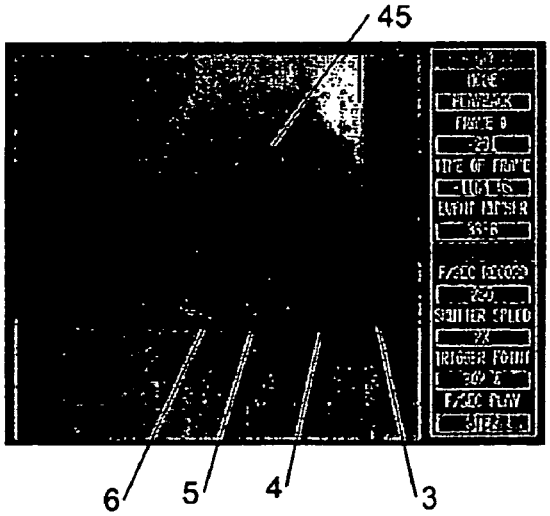
FIG. 3C shows an impact test on a portion of a garment of the invention from a third drop height.
Figure 3D:
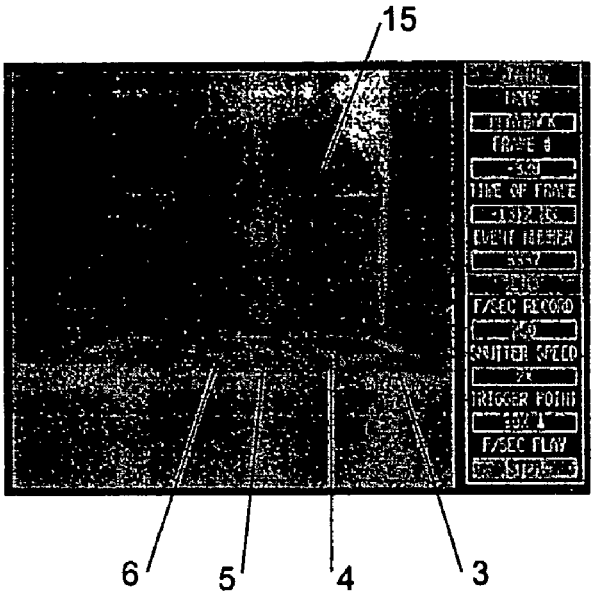
FIG. 3D shows an impact test on a portion of a garment of the invention from a fourth drop height.

FIG. 3A shows an impact on a portion of the garment where in the impactor had a drop height of 250 mm. FIG. 3B shows an impact on a portion of the garment where in the impactor bad a drop height of 500 mm and corresponds to level 1 of the BETA standard. FIG. 3C shows an impact on a portion of the garment where in the impactor had a drop height of 750 mm and exceeds forces specified by level 1 of the BETA standard. FIG. 3D shows an impact on a portion of the garment where in the impactor had a drop height of 1000 mm. These Figures show that the load is distributed over all plates 3-6.

Figure 4:
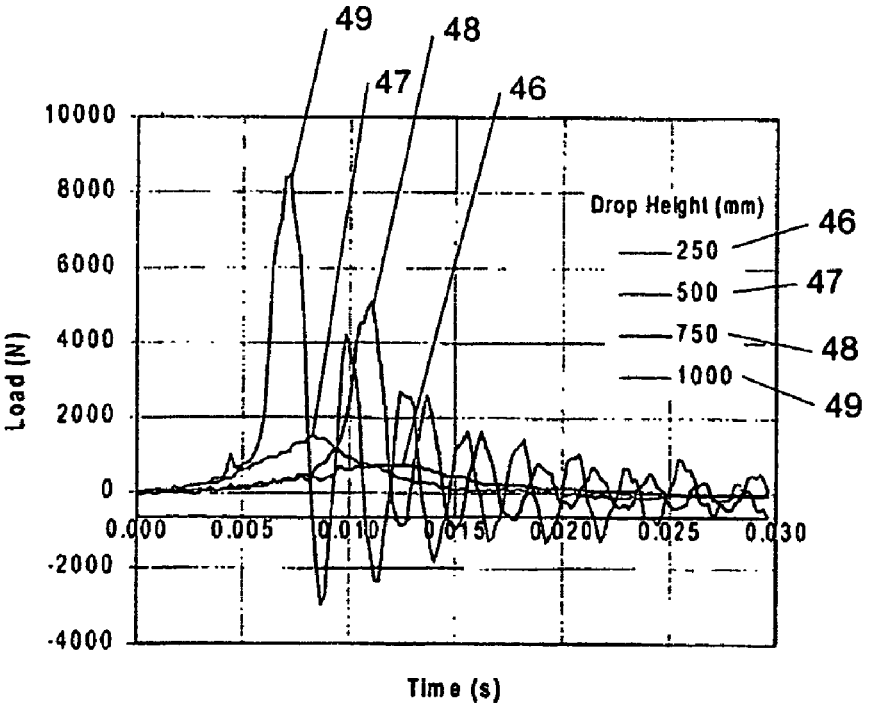
FIG. 4 is a graph showing the loading on the panels for each of the impact tests of FIGS. 3A to 3D.

FIG. 4 shows the load on the portion of the garment under test for the tests depicted in FIGS. 3A to 3D. The load line corresponding to the drop height of 250 mm is shown by line 46, the load line corresponding to the drop height of 500 mm is shown by line 47, the load line corresponding to the drop height of 750 mm is shown by line 48, and the load line corresponding to the drop height of 1000 mm is shown by line 49. As can be seen in FIG. 4 as the drop height of the impactor increased from 250 mm to 100 mm the force on the garment under test also increased. The duration of the primary impulse decreased from 0.02 s at 250 mm and 500 mm drop heights, which correspond to BETA level 3 to 0.005 s at 1000 mm drop height, which exceeds requirements of BETA level 3.

The tests were repeated and show consistency between tests. Moving the portion of the garment under the impactor to alter the number of plates under impact and repeating the test further tested the portion of the garment. The tests show the impact performance of the garment of the invention as well as illustrating the deformability and resiliency of the plates of the garment.

Figure 5:
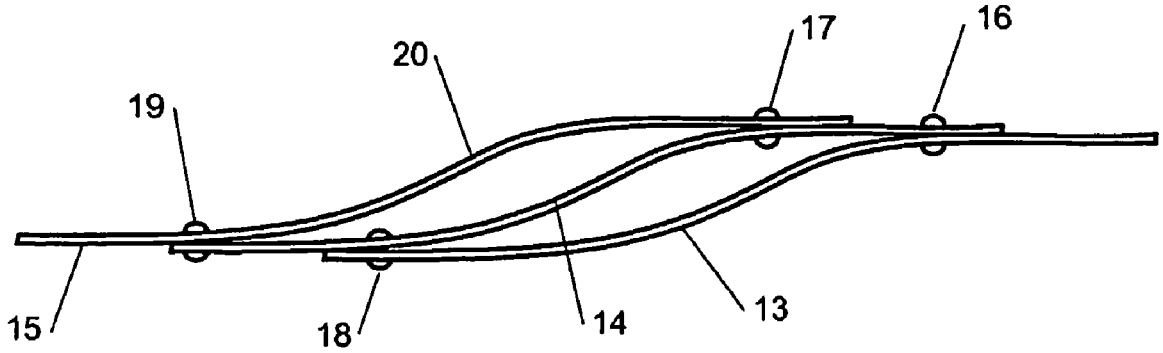
FIG. 5 shows the connections between a series of panels of one embodiment of the invention.

FIG. 5 shows a second embodiment of panels suitable for use as part of the garment of the invention. Panels 13 to 15 have an arcuate cross-section 20 that extends between two sides. The cross-section includes a higher area and a lower area. The cross-section extends through the panel from the front end to the back end providing a panel with regular cross-section.

In use panel 14 overlaps both panel 13 and panel 15 in two places. In the embodiment shown in FIG. 5 at each point of overlap a rivet 16-19 connects the two panels. As described with reference to the embodiment of FIG. 2 the rivets are adapted to provide sliding engagement between the panels. In the embodiment of FIG. 5, due to the shape of the panels up to four rivets can be provided per panel. Alternatively fewer than four rivets may be used per panel, for example only two rivets may be used, each rivet for connecting the panel to a different adjacent panel.

In another alternative embodiment the garment may be provided with channels in the same way as the garment of FIG. 1. These channels also allow the panels to move relatively to each other while ensuring that the entire inner layer of the garment under the panels is covered by at least one panel.

FIG. 6 is a top view showing the panels of FIG. 5. A partial view of panels 14 and 15 is shown. When viewed from the top the panels appear rectangular. As shown in FIG. 6 the panels may have more than one connection point to another panel along the length of the panel. The panels are not shown in proportion in FIG. 6 and only show two connection points.

Rivets 17, 17*a*, 16 and 16*a* are shown in FIG. 6. Each rivet connects two adjacent panels. As can been seen in this figure the rivets are able to slidingly move in slots 21-23. This allows the panels to slidingly move relative to each other. In one embodiment one panel is provided with a slot and the other panel with a corresponding hole for the rivet. In another embodiment both panels are provided with corresponding slots for the rivets. Although the connection means between corresponding panels have been described as rivets it should be understood that any other suitable connection means that allows the panels to move slidingly with respect to each other could also be used.

Figure 7:
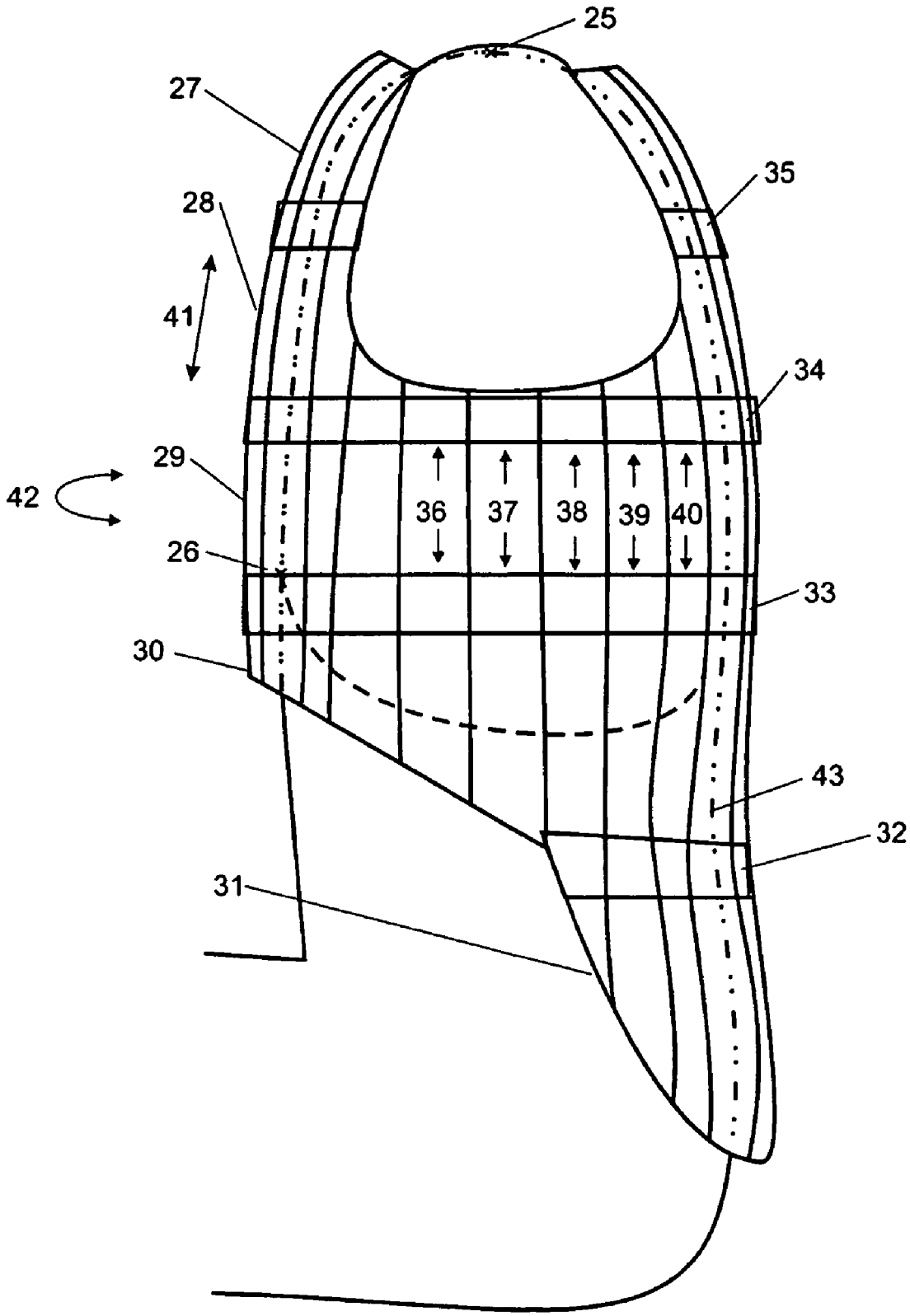
FIG. 7 is an outline of a garment using the panel system of the invention.

FIG. 7 shows one embodiment of garment of the invention, which is a jacket or a vest. The garment includes rows 27-31 of panels. The garment begins near the shoulder 25 of a wearer and extends past the breastbone 26 and ribcage (shown as a dotted line) of the wearer. The garment may also extend down the back of the wearer to the buttocks of the wearer as shown in FIG. 7.

The garment includes a plurality of rows 27-31 of panels. The panels are orientated in the columns in the direction of arrow 41, which corresponds to arrow 41 in FIG. 6. The sliding movement of panels relative to each other is therefore in the direction of arrows 41 and 42 of FIG. 7.

The rows of panels may be arranged to overlap as shown in areas 32-35 of FIG. 7. Alternatively areas 32 to 35 may be areas where no panels are provided. In equestrian and other similar embodiments the garment may be provided with areas of perforations that allow air to flow through the garment. This provides breathability to the garment and prevents or reduces any insulating effects of the garment. The arrangement of the panels in rows also provides flexibility to the garment allowing a wearer more movement than conventional equestrian protection using foam plastics blocks. In other embodiments of garment such as bullet proof vests no perforations are provided.

Also shown in FIG. 7 are channels 36-40. In one embodiment the garment is supplied with channels and each channel houses a column of panels. In other embodiments the garment is supplied with only one channel per row and the panels are attached in a sliding manner by rivets or other means as discussed with reference to FIGS. 2, 5 and 6.

The shape of the panels may be adjusted to fit the contours of the body and the garment. For example, the shape of the panels may alter around the armpits of the garment. In equestrian garments of the invention foam plastics may be provided in portions of these areas to maintain the energy absorbing and spreading qualities of the garment. The panels may continue over the shoulders of the garment.

Preferably the inner and outer layers of the garment are formed from fabric. Ideally the fabric is breathable. In one embodiment the fabric of the inner and outer layers of the garment includes one-way stretchability in the direction of arrow 42 of FIG. 7.

The garment may include a fastening portion down one side. For example, the garment may be designed to fit over the head of a wearer and then be fastened between the bottom of the garment and an armpit. One preferred fastening means includes Velcro in the inner layers of the complementary sides of the garment and a zip on the outer layers of the complementary sides of the garment. In this way once a wearer has placed the garment over their head the wearer pushes the Velcro together and then does the zip up.

This maintains continuous rows of panels around the body of the user with panels maintaining the sliding relationship.

In other embodiments, for example flak jackets, the garment may open at the front.

When a wearer of the garment is subject to an impact, for example by falling off a horse, the panels of the garment absorb and spread the impact energy. If the impact is of sufficient force the panels of the garment may deform. The absorbing and spreading of energy by the garment protects the wearer from the full force of the impact. It should be noted that although use of the garment has been described with relation to horse riding to garment may be used in other sport, recreation, or commercial activities to provide impact protection. The garments of the invention are not limited to the vest shown in FIG. 7 but may be other garments for protecting other areas of the body. For example, suitably formed panels may be used in hardhats, footwear, bullet proof vests, shin, knee, elbow protection, and even eye protection.

It should be noted that the panels may vary in size and shape in a garment. For example, when the garment is footwear, the panels may not all be the same size. The plates may also be arranged in different configurations in different garments. In elbow and knee protection garments, the plates may be arranged to flex around the elbows or knee.

The foregoing describes the invention including preferred forms thereof. Alterations and modifications as will be obvious to those skilled in the art are intended to be incorporated within the scope hereof as defined in the accompanying claims.

I claim:

1. An energy absorbing and/or spreading garment including:

an inner layer, an outer layer, a plurality of resilient panels of arcuate cross-section housed between the inner layer and the outer layer of the garment, each of the plurality of resilient panels arranged to overlap and slide relative to at least one adjacent panel of the plurality of resilient panels to spread and/or absorb energy upon impact; and a plurality of channels or pockets between the inner layer and the outer layer, each of the plurality of channels housing one or more of the plurality of resilient panels which are freely movable in the channels or pockets.

2. An energy absorbing and/or spreading garment as claimed in claim 1 wherein each channel or pocket is arranged to house one column of said plurality of arcuate in cross-section panels.

3. An energy absorbing and/or spreading garment as claimed in claim 1 wherein in cross-section shape each panel of said plurality of panels includes two lower side portions and a higher middle portion.

4. An energy absorbing and/or spreading garment as claimed in claim 3 wherein the plurality of panels are arranged so that one side portion of a first panel is adjacent to a middle portion of a second panel and a side portion of the second panel is adjacent a middle portion of a third panel.

5. An energy absorbing and/or spreading garment as claimed in claim 4 wherein the plurality of panels are arranged in a symmetrical pattern with the axis of symmetry running between the center of the front of the garment and the center of the back of the garment.

6. An energy absorbing and/or spreading garment as claimed in claim 5 wherein;

a center panel of the plurality of panels with a higher middle portion and lower side portions is situated between a first left side panel and a first right side panel of the plurality of panels, both the first left side panel and the first right side panel have one side portion adjacent a middle portion of the center panel, a second left side panel has one side portion adjacent the middle of the first left side panel, and a second right side panel has one side portion adjacent the middle of the first right side panel.

7. An energy absorbing and/or spreading garment as claimed in claim 1 wherein the cross-section of each panel of the plurality of panels extends between a first side portion and a second side portion and includes a higher portion and a lower middle portion.

8. An energy absorbing and/or spreading garment as claimed in claim 7 wherein;

the plurality of panels are arranged so that a lower middle portion of a first panel is adjacent a first side portion of a second panel, a second side portion of the first panel is adjacent to an upper middle portion of the second panel, a lower middle portion of the second panel is adjacent to a first side portion of a third panel, and a second side portion of the second panel is adjacent to an upper middle portion of the third panel.

9. An energy absorbing and/or spreading garment as claimed in claim 1 wherein the plurality of panels are arranged in a sliding relationship using a rivets and slots.

10. An energy absorbing and/or spreading garment as claimed in claim 9 wherein at least one panel is provided with a slot and the panels are riveted with the rivet arranged to slide along the slot thereby allowing a sliding relationship between adjacent panels.

11. An energy absorbing and/or spreading garment as claimed in claim 1 wherein the panels are arranged to form rows across the garment with each one of the panels in the row being housed in a channel or connected to the adjacent panel (s) by a suitable sliding connection means.

12. An energy absorbing and/or spreading garment as claimed in claim 1 wherein the garment is provided with more than one row of panels where the panels form columns in each channel.

13. An energy absorbing and/or spreading garment as claimed in claim 12 wherein the garment is provided with an overlap between the plurality of panels in each channel or pocket.

14. An energy absorbing and/or spreading garment as claimed in claim 1 wherein the plurality of panels are formed from resilient deformable material.

15. An energy absorbing and/or spreading garment as claimed in claim 14 wherein the panels are formed from plastics.

16. An energy absorbing and/or spreading garment as claimed in claim 14 wherein the panels are formed from a rigid material.

17. An energy absorbing and/or spreading garment as claimed in claim 14 wherein the plurality of panels are formed from PVC.

18. An energy absorbing and/or spreading garment as claimed in claim 14 wherein the plurality of panels are formed from metal.

19. An energy absorbing and/or spreading garment as claimed in claim 14 wherein, after one of said panels of said plurality of panels has received an impact of greater than a predetermined force, it permanently deforms.

20. An energy absorbing and/or spreading garment as claimed in claim 1 wherein the garment is provided with perforations to allow air to flow through the garment to a wearer.

21. An energy absorbing and/or spreading garment as claimed in claim 1 wherein the garment is provided with perforations to allow air to flow through the garment to a wearer.

22. An energy absorbing and/or spreading garment as claimed in claimed 21 wherein the fabric of the inner and outer layers includes one-way stretchability.

23. An energy absorbing and/or spreading garment as claimed in claim 22 wherein the stretchability is arranged to run across the garment.

* * * * *